US010736399B2

(12) United States Patent
Choekyi et al.

(10) Patent No.: US 10,736,399 B2
(45) Date of Patent: Aug. 11, 2020

(54) COSMETIC HOLDER AND GRIP SYSTEM

(71) Applicants: Kunga Choekyi, Old Saybrook, CT (US); Jampa Tsondue, Old Saybrook, CT (US); Richard W. Schlueter, Clinton, CT (US)

(72) Inventors: Kunga Choekyi, Old Saybrook, CT (US); Jampa Tsondue, Old Saybrook, CT (US); Richard W. Schlueter, Clinton, CT (US)

( * ) Notice: Subject to any disclaimer, the term of this patent is extended or adjusted under 35 U.S.C. 154(b) by 0 days.

(21) Appl. No.: 16/377,007

(22) Filed: Apr. 5, 2019

(65) Prior Publication Data

US 2019/0307224 A1 Oct. 10, 2019

Related U.S. Application Data

(60) Provisional application No. 62/653,080, filed on Apr. 5, 2018.

(51) Int. Cl.
*A45D 29/00* (2006.01)
*A45D 34/00* (2006.01)

(52) U.S. Cl.
CPC ..... *A45D 29/00* (2013.01); *A45D 2034/002* (2013.01)

(58) Field of Classification Search
CPC ..... A45D 29/00; A45D 2034/002; A45D 2033/001; A45D 2040/0006; A45D 40/26; A45D 40/28; A47F 5/10
See application file for complete search history.

(56) References Cited

U.S. PATENT DOCUMENTS 1,759,390 A * 5/1930 Brandt ..... A45D 29/20 211/74
2,385,114 A * 9/1945 Steckler ..... B65D 55/0836 215/274
2,888,020 A * 5/1959 Schultz ..... A45D 29/18 132/73.5
2,963,167 A 12/1960 Alexandra
3,978,871 A * 9/1976 Huston ..... A45D 29/18 132/73
4,782,957 A * 11/1988 Kernodle, Sr. ..... A47B 13/16 211/69.5
5,141,188 A 8/1992 DeBlasi
5,772,163 A * 6/1998 Young ..... A45D 40/265 248/139
5,913,312 A 6/1999 Donnell
6,065,477 A * 5/2000 Doo ..... A45D 34/04 132/73
6,371,131 B1 * 4/2002 Finocchiaro ..... A45D 29/20 132/294
6,685,147 B1 2/2004 Ma
7,448,767 B2 * 11/2008 Zhang ..... A45D 34/045 362/118
8,789,541 B1 * 7/2014 Evans ..... A45C 5/005 132/294

(Continued)

*Primary Examiner* — Ko H Chan
(74) *Attorney, Agent, or Firm* — Acumen Intellectual Property; Michael C. Balaguy

(57) ABSTRACT

A device for holding at least one nail polish bottle; the device includes a base, at least one cavity and at least one insert. The device is useful for holding, retaining, and gripping cosmetic bottles and containers which effectively allows for a hands-free application of nail polish and other cosmetics.

8 Claims, 23 Drawing Sheets

(56) References Cited

U.S. PATENT DOCUMENTS

| | | | | |
|---|---|---|---|---|
| 9,125,471 | B2 * | 9/2015 | Ko | A45D 34/00 |
| 9,573,748 | B2 * | 2/2017 | Park | B65D 81/051 |
| 2004/0089774 | A1 * | 5/2004 | Pace | A45D 34/00<br>248/146 |
| 2004/0231686 | A1 | 11/2004 | Watson | |

* cited by examiner

COSMETIC HOLDER AND GRIP SYSTEM

CROSS REFERENCE TO RELATED APPLICATION

The present application is related to and claims priority to U.S. Provisional Patent Application No. 62/653,080 filed Apr. 5, 2018, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of holders and more specifically relates to a holder and grip combination for cosmetic and non-cosmetic holders.

2. Description of Related Art

Users of cosmetics often have a number of bottles or containers holding various cosmetics. These are often stored or gathered together and placed in a storage area in a haphazard fashion, such that locating and retrieving a particular cosmetic may become a frustrating and time-consuming event.

Further, when in use, some cosmetics bottles, such as those used for storing nail polish, are often placed on a flat, uneven or slippery surface while the container or bottle remains open. For example, nail polish bottles are typically supplied with a lid or cap that includes a brush or applicator. As a result, the bottle remains open while the brush is being used to apply the nail polish. If the bottle is accidentally knocked over, the nail polish will spill out, resulting in a mess that is quite often difficult to clean. Because it may be necessary to re-dip the brush or applicator into the bottle of nail polish, the insertion and removal of the applicator itself often causes the bottle to be tipped over. As a result, such spills are not uncommon. In addition, polish may dry out quicker resulting in less usability of the product.

It is a well-known phenomenon that when a brush is placed in a bottle of nail polish when the bottle is upright it is very difficult to extract the necessary amount of liquid from the bottle if the bottle is less than half full. However, if the bottle is tipped, it is much easier to extract the liquid. As the contents of the bottle reduce, the bottle must be tipped at slightly greater angles. A nail polish bottle holder that could hold the nail polish bottle at different angles is therefore necessary.

U.S. Pat. No. 5,913,312 to Karla R. Donnell relates to a nail polish bottle holder. The described nail polish bottle holder includes a portable cosmetic bottle holder formed from a sheet of flexible foam material having a thickness and having a generally U-shaped configuration that is defined by a periphery. The foam is provided with a plurality of receptacles for receiving and holding cosmetic bottles. The foam material has an interior spaced inward from the periphery that defines a work space where one can rest their hands when applying cosmetics, such as nail polish. A rigid backing layer may be joined to the lower surface of the foam.

BRIEF SUMMARY OF THE INVENTION

In view of the foregoing disadvantages inherent in the known cosmetic holders art, the present disclosure provides a novel cosmetic holder and grip system. The general purpose of the present disclosure, which will be described subsequently in greater detail, is to provide a device useful for holding, retaining, and gripping cosmetic bottles and containers which effectively allows for a hands-free application of nail polish and other cosmetics.

A device is disclosed herein. The device includes a base; and at least one cavity in the base. The at least one cavity may have a cavity-capacity sized to selectively hold at least a bottle end of a nail polish bottle. An at least one insert may be provided and configured for removable placement within the at least one cavity. The at least one insert may include a hollow may have a hollow-capacity sized to selectively grip and hold at least a cap end of the nail polish bottle.

A method of using the device is also disclosed herein. The method of using device may comprise the steps of: providing the device as above; removing the at least one insert from the at least one cavity; placing the bottle end of the nail polish bottle into the at least one cavity; and placing the cap end of the nail polish bottle into the hollow.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a cosmetic holder and grip system, constructed and operative according to the teachings of the present disclosure.

The various embodiments of the present invention will hereinafter be described in conjunction with the appended drawings, wherein like designations denote like elements.

DETAILED DESCRIPTION

Figure 1:
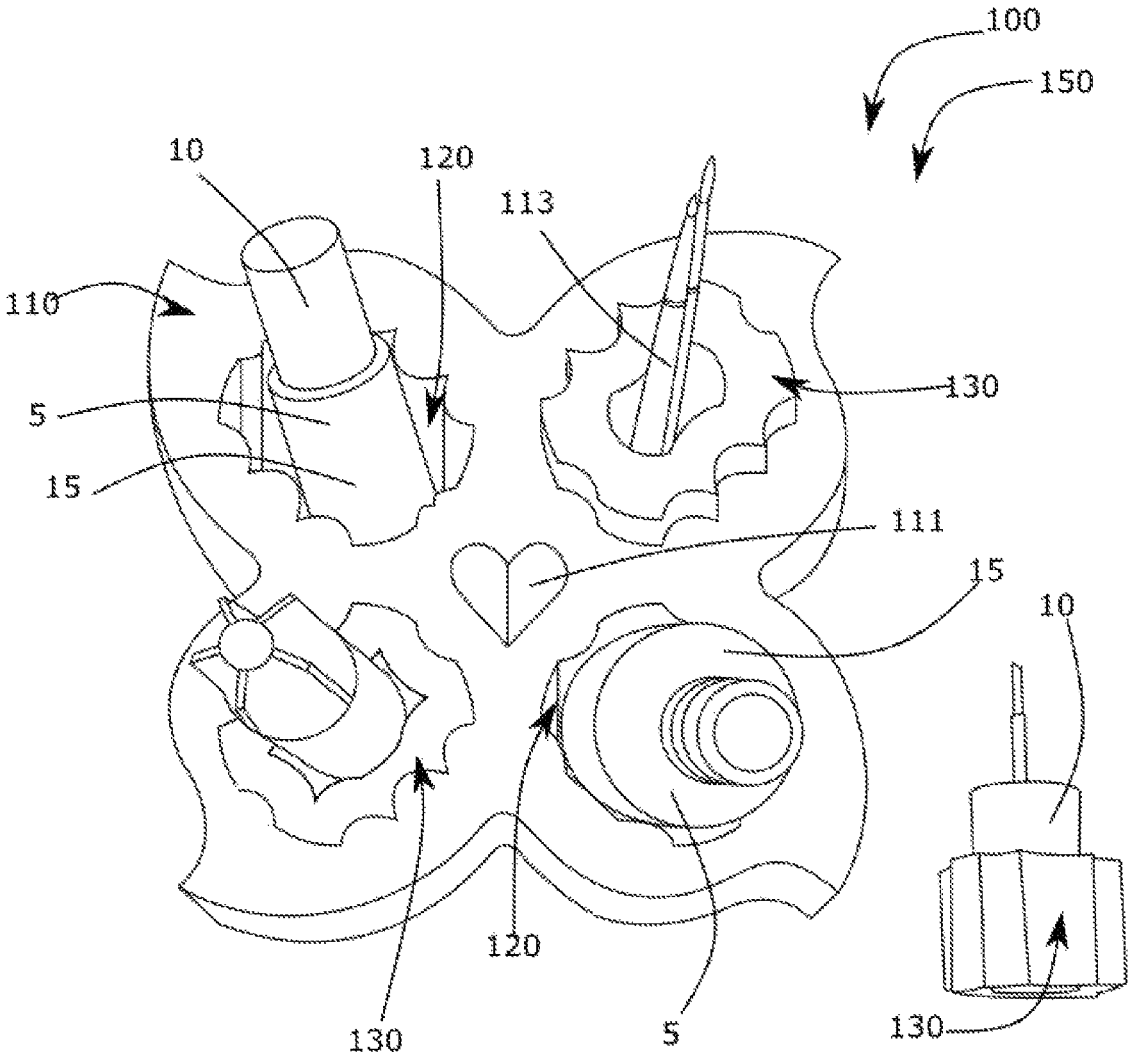
FIG. 1 is a top-side perspective view of the device during an 'in-use' condition, according to an embodiment of the disclosure.

As discussed above, embodiments of the present disclosure relate to cosmetic holders and more particularly to a cosmetic holder and grip system as used to improve the use of nail polish bottles and nail accessories.

Generally, disclosed is a cosmetic bottle holder (such as nail polish) which may be structured to retain several bottles in a secure grip at a tilt that can placed on multiple surfaces with non-slip grip base. The cosmetic bottle holder may further comprise at least one nail polish bottle cap grip configured to slip over polish bottle caps. Further, the cosmetic bottle holder may comprise a plurality of fingered cutouts which are adapted to grip various sizes of polish bottle caps.

The cosmetic bottle holder may include a soft foam material which provides a comfortable grip over the polish bottle's hard plastic caps while the wide diameter of the grip provides a user with the ability to adjust the pressure of their grip of the bottle cap for better control of their brush strokes, while overall providing a better grip for opening bottle caps. The polish posy system may be easily hand-held as users may slip fingers through 'pockets' of the holder for a secure grasp while its light weight foam and small size lends to its hand-held portability.

The cosmetic bottle holder may be configured to hold at least four bottles in addition to holding small nail tools. We have other designs for three and two bottle holders. We have designs for more than four holders. To achieve this, the cosmetic bottle holder may include at least four pockets. The four pockets may include a small pocket for holding smaller to standard sized nail polish bottles; and three standard sized pockets to fit standard to large sized nail polish bottles. A base of the cosmetic bottle holder may comprise an anti-skid base so it may be left on any surface. Tools, such as nail files, brushes, and the like, may be retained within the various openings of the cosmetic bottle holder. Further, the cosmetic bottle holder may include a plurality of slits. The slits may allow hand tools to be retained in an upright position.

The cosmetic bottle holder may be fabricated using a flexible and deformable material (such as foam). In one embodiment, the cosmetic and tool holder may comprise cross linked polyethylene (XLPE), Ethylene Vinyl Acetate, (EVA) or any other suitable equivalent. In alternative embodiments, the tool holder may be fabricated using silicone rubber. Further, the cosmetic bottle holder may comprise an anti-skid base layer which may be attached to the bottom via a gluing, chemical, or heat process. The base layer may comprise rubber or other material having properties known in the art for providing traction. In other embodiments, the cosmetic and tool holder may comprise a plurality of fingered cutouts. Further to this, there may be an added neoprene layer located between the foam base layer and the anti-skid base to provide greater stability. The fingered cutouts may comprise small, medium, and large sizes useful for holding and gripping cosmetic bottles (such as nail polish) of different dimensions. Preferably, there may be three sizes: 1 small, 1 medium and 2 large configured to accommodate differently sized nail bottle caps. In addition, the shape outline may comprise letters, animals, flowers, or some other abstract shape. Various methods may be used to fabricate, from die cutting to waterjet cutting to extruding to molding.

Referring now more specifically to the drawings by numerals of reference, there is shown in FIGS. 1-9, various views of a device 100.

FIG. 1 shows a device 100 during an 'in-use' condition 150, according to an embodiment of the present disclosure. As illustrated, the device 100 may include a base 110, at least one cavity 120 and at least one insert. The device 100 may be used for holding at least one nail polish bottle 5; the at least one nail polish bottle 5 including a cap end 10 and a bottle end 15. Further, as shown, the device 100 may include a nail tool pocket 111. In one embodiment, the nail tool pocket 111 may have a capacity configured to selectively hold at least one nail tool 113. In one embodiment, the device 100 may be provided as a kit along with nail polish bottles and nail accessories (not pictured).

Figure 2:
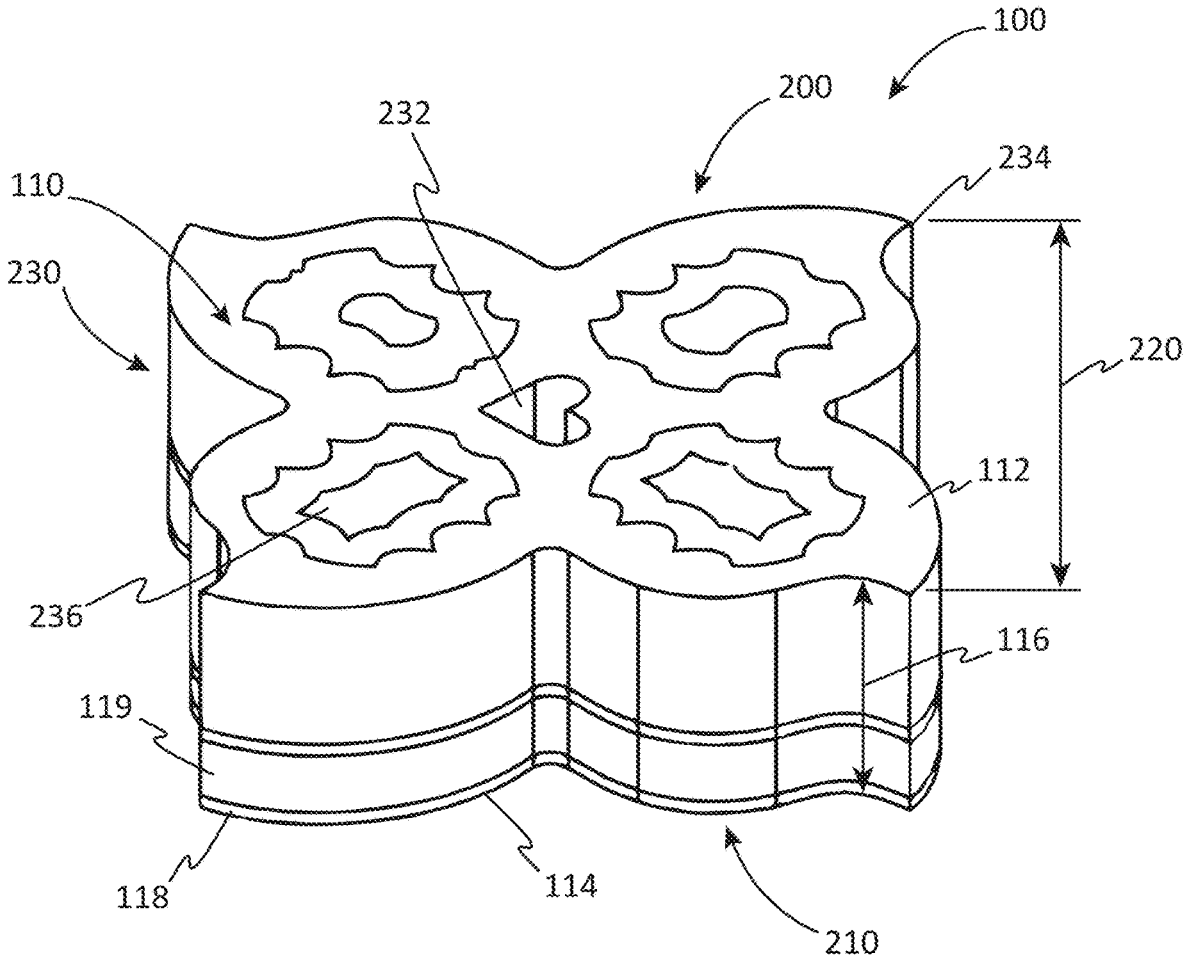
FIG. 2 is a side-top perspective view of the device of FIG. 1, according to an embodiment of the present disclosure.

FIG. 2 shows a side-top perspective view of the device 100 of FIG. 1, according to an embodiment of the present disclosure. The base 110 may include a top surface 112, a bottom surface 114 and a thickness 116 therebetween. The base 110 may be constructed from a foam material. In one embodiment, the foam material may be Cross Linked Polyethylene Foam. However, other foam materials are contemplated, as well as materials other than foam materials. The thickness 116 of the base 110 may be sized to fit at least a portion of the nail polish bottle 5 (FIG. 1). For example, the thickness 116 of the base 110 may be at least 2 inches. Base 110 may further be characterized by a top surface 200, a bottom surface 210, and a thickness 220 therebetween, such that top surface 200 and bottom surface 210 are each flat and parallel to each other. Yet further, base 110 may have four lobes 230 which are arrayed radially about a center 232 of base 110. As such, four lobes 230 may be arrayed about nail tool pocket 111 (FIG. 1). Each of four lobes 230 may have pointed terminating edge 234, which is distal to center 232 of base 110. Each of four lobes 230 may have a cavity 236. Nail tool pocket 111 (FIG. 1) may be an aperture central to base 110.

Preferably, the bottom surface 114 of the base 110 may include a non-slip material 118. In one embodiment, the non-slip material 118 may be constructed from a rubber material. In another embodiment, the non-slip material 118 may be a silicone material. The non-slip material 118 may allow a user to place the base 110 on any surface. Further to this, between the foam material and the non-slip material 118 may be a neoprene material 119 to provide added durability.

Figure 3A:
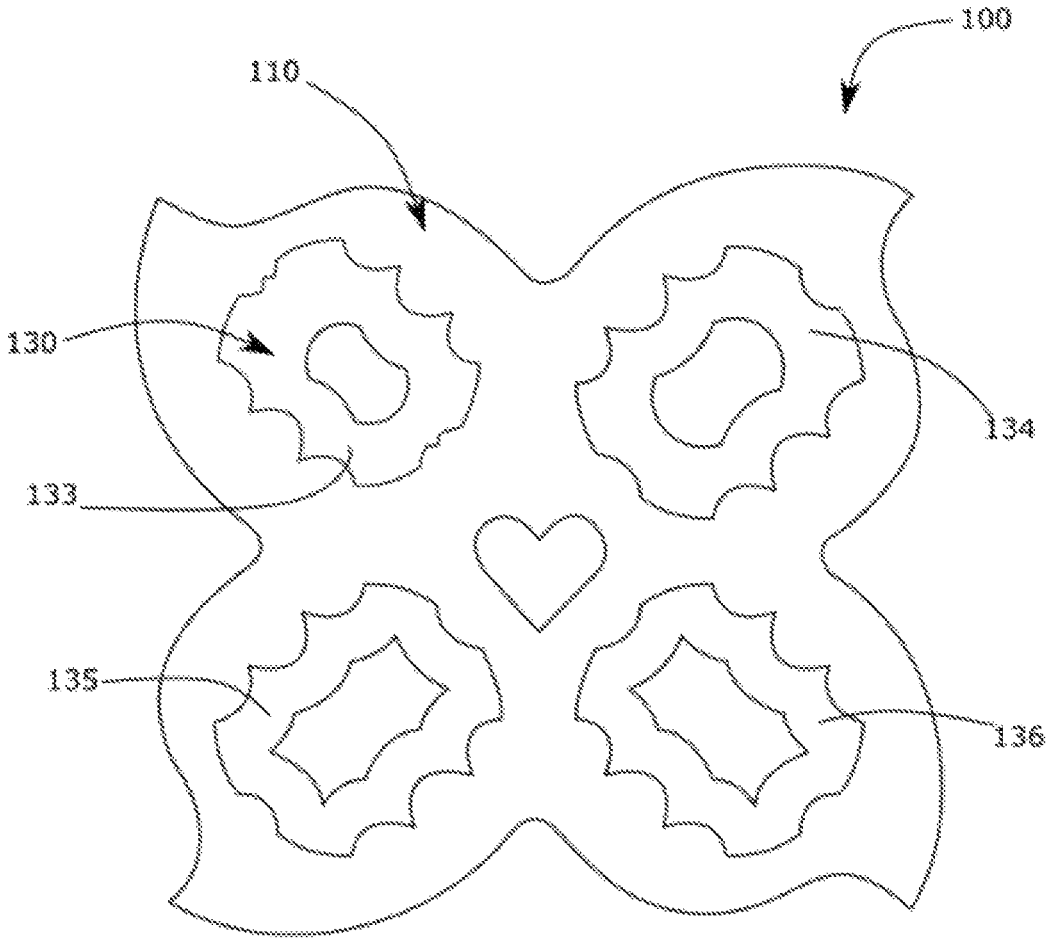
FIG. 3A is a top perspective view of the device of FIG. 1, according to an embodiment of the present disclosure.
Figure 3B:
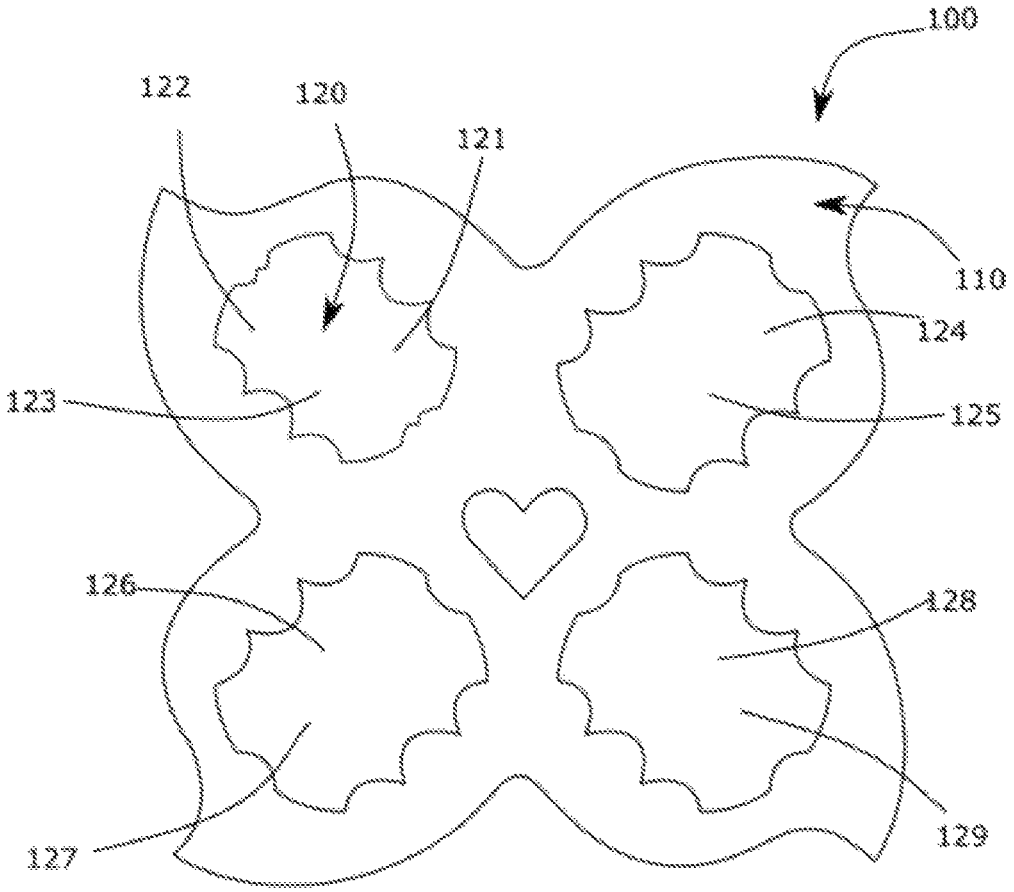
FIG. 3B is a top perspective view of the device of FIG. 1, according to an embodiment of the present disclosure.
Figure 4:
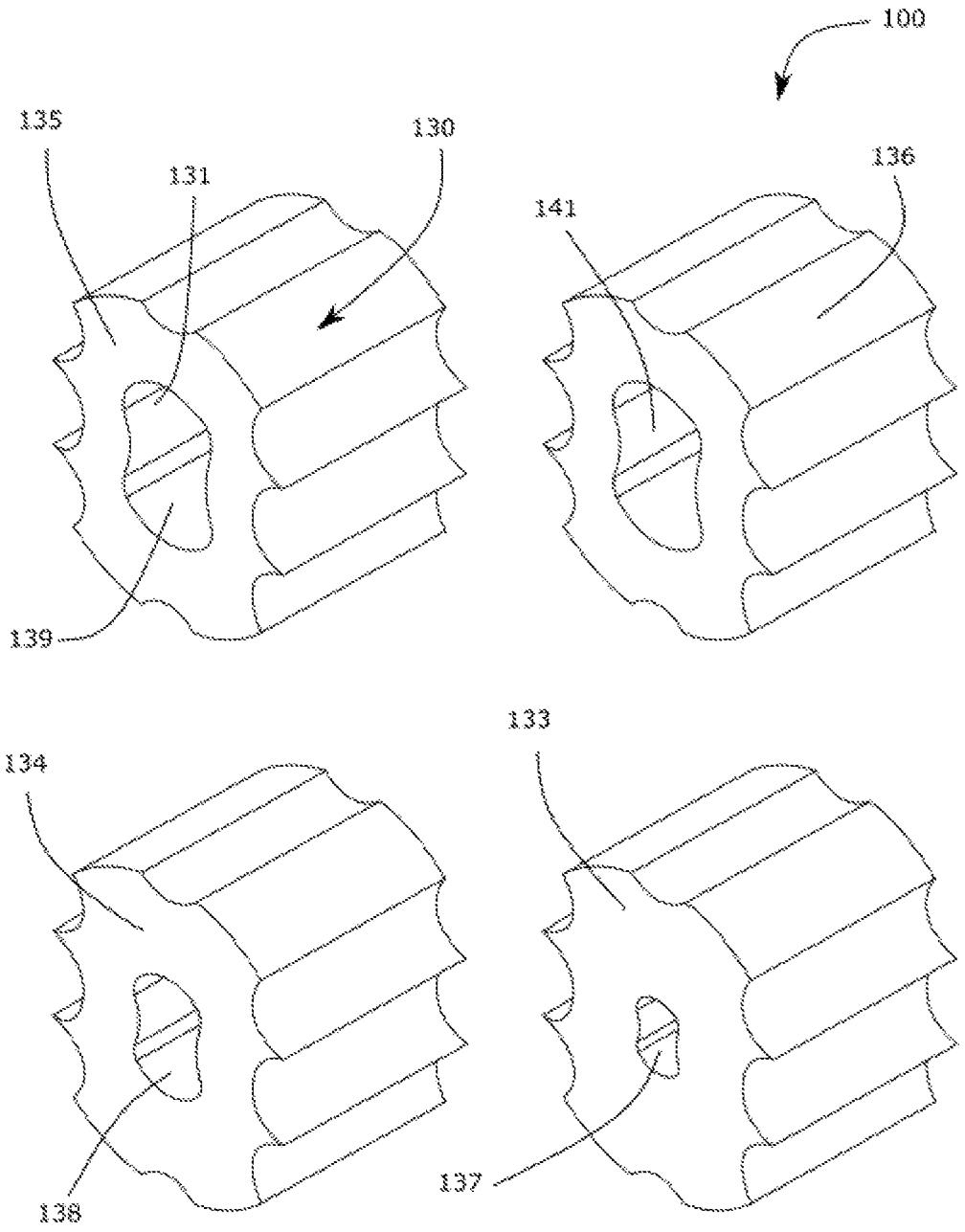
FIG. 4 is a side perspective view of the device of FIG. 1, according to an embodiment of the present disclosure.

FIGS. 3A-4 shows various perspective views of the device 100 of FIG. 1, according to an embodiment of the present disclosure. As shown, the at least one cavity 120 may be in the base 110. The at least one cavity 120 may have a cavity-capacity 121 sized to selectively hold at least the bottle end 15 (FIG. 1) of the nail polish bottle 5 (FIG. 1). Preferably, the at least one cavity 120 may comprise four cavities 120. The four cavities 120 may include a first cavity 122 having a first cavity-capacity 123, a second cavity 124 having a second cavity-capacity 125, a third cavity 126 having a third cavity-capacity 127 and a fourth cavity 128 having a fourth cavity-capacity 129. Preferably, the first cavity-capacity may be smaller than the second cavity-capacity 125, the third cavity-capacity 127 and the fourth cavity-capacity 129, and the second cavity-capacity 125, the third cavity-capacity 127 and the fourth cavity-capacity 129 may be equal. In this embodiment, the first cavity 122 may be configured to hold a smaller nail polish bottle 5 (FIG. 1), and the second cavity 124, the third cavity 126 and the fourth cavity 128 may each be configured to medium-large nail polish bottles 5.

The at least one insert 130 may be configured for removable placement within the at least one cavity 120. The at least one insert 130 may include a hollow 131 having a hollow-capacity 132 sized to selectively grip and hold at least the cap end 10 of the nail polish bottle 5. Preferably, the at least one insert 130 may comprise four inserts 130. The exactly four inserts 130 may include a first insert 133, a second insert 134, a third insert 135 and a fourth insert 136. As shown, each of the four inserts 130 may be configured for removable placement in each of the four cavities 120. For example, there may be one insert 130 to every cavity 120.

The first insert 133 may include a first hollow-capacity 137, the second insert 134 may include a second hollow-capacity 138, the third insert 135 may include a third hollow-capacity 139, and the fourth insert 136 may include a fourth hollow-capacity 141. Preferably, the first hollow-capacity 137 may be smaller than the second hollow-capacity 138, the third hollow-capacity 139 and the fourth hollow-capacity. Further, the second hollow-capacity 138 may be smaller than the third hollow-capacity 139 and the fourth hollow-capacity 141. In addition to this, the third hollow-capacity 139 and the fourth hollow capacity 141 may be equal. For example, the first hollow-capacity 137 may be the smallest, configured to grip the cap end 10 (FIG. 1) of smaller nail polish bottles 5 (FIG. 1). The second hollow-capacity 138 may be medium configured to grip the cap end 10 (FIG. 1) of the medium sized nail polish bottles 5 (FIG. 1). The third hollow-capacity 139 and the fourth hollow-capacity 141 may both be large and configured to grip the cap end 10 (FIG. 1) of large sized nail polish bottle 5 (FIG. 1).

FIGS. 5A-8D shows various perspective views of the device 100 of FIG. 1, according to an embodiment of the present disclosure. It should be appreciated that the device 100 is not confined to including only four cavities 120 and four inserts 130. The device 100 is contemplated to include at least one cavity 120 and at least one insert 130 and may include as many cavities 120 and inserts 130 as desired by manufacturer or consumer. Further, the device 100 may include a variety of different shapes.

Figure 5A:
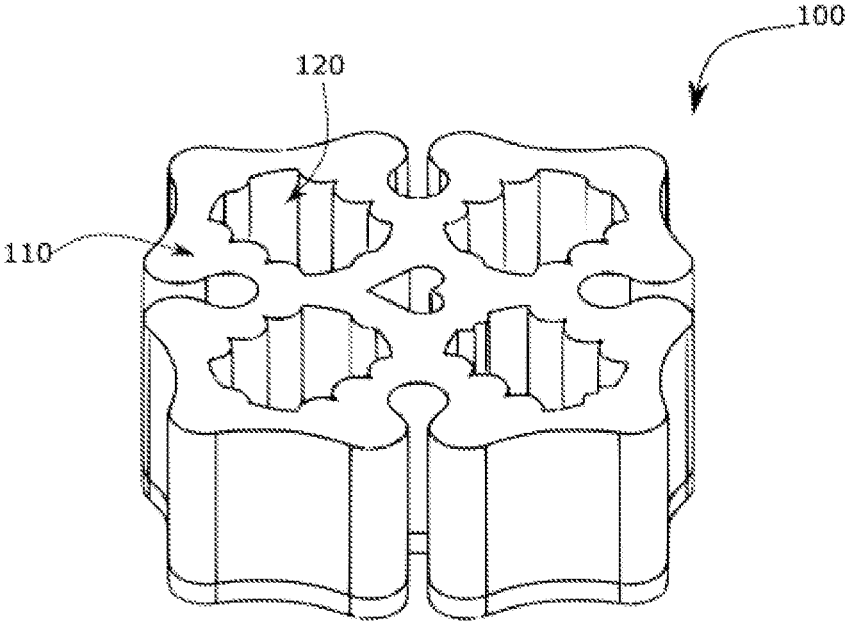
FIG. 5A is a side-top perspective view of the device of FIG. 1, according to an embodiment of the present disclosure.
Figure 5B:
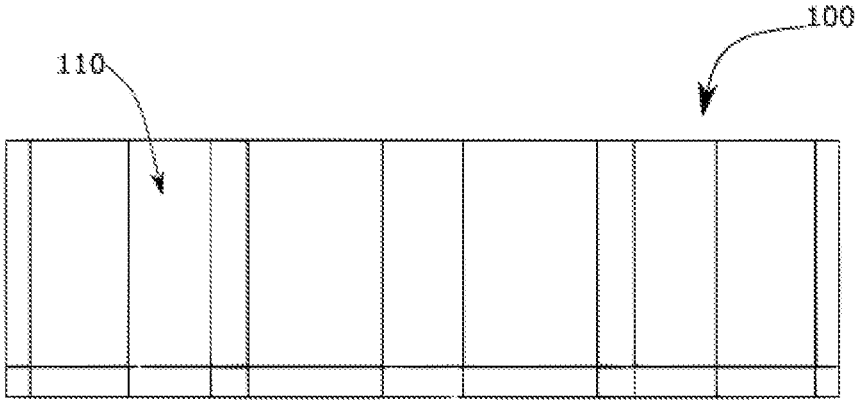
FIG. 5B is a side perspective view of the device of FIG. 1, according to an embodiment of the present disclosure.
Figure 5C:
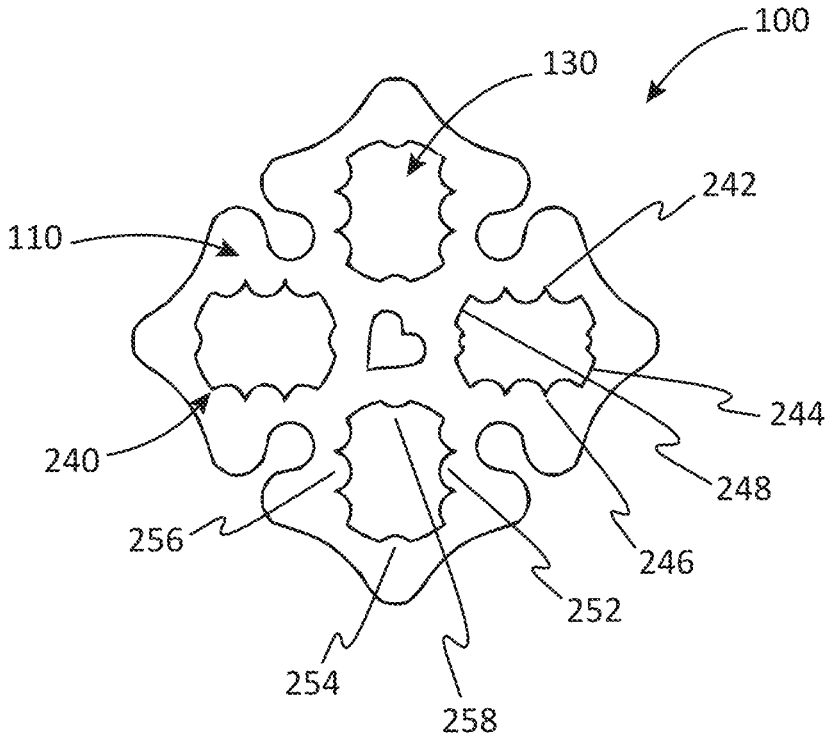
FIG. 5C is a top perspective view of the device of FIG. 1, according to an embodiment of the present disclosure.
Figure 5F:
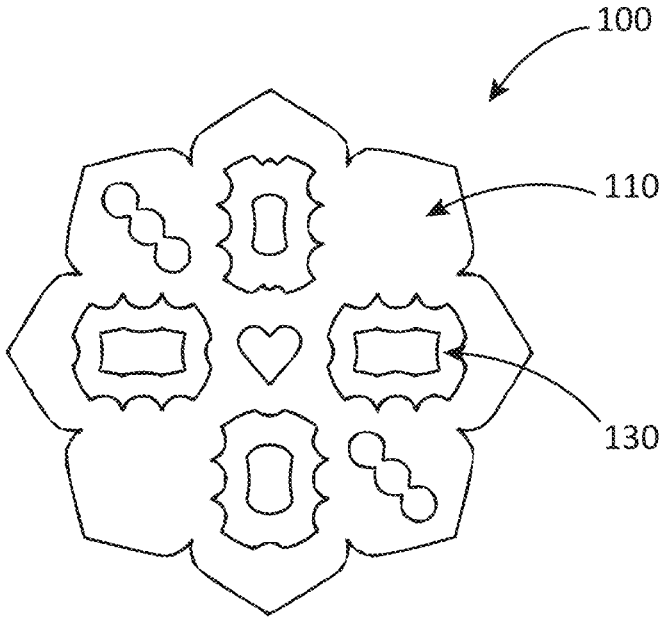
FIG. 5F is a top perspective view of the device of FIG. 1, according to an embodiment of the present disclosure.
Figure 5D:
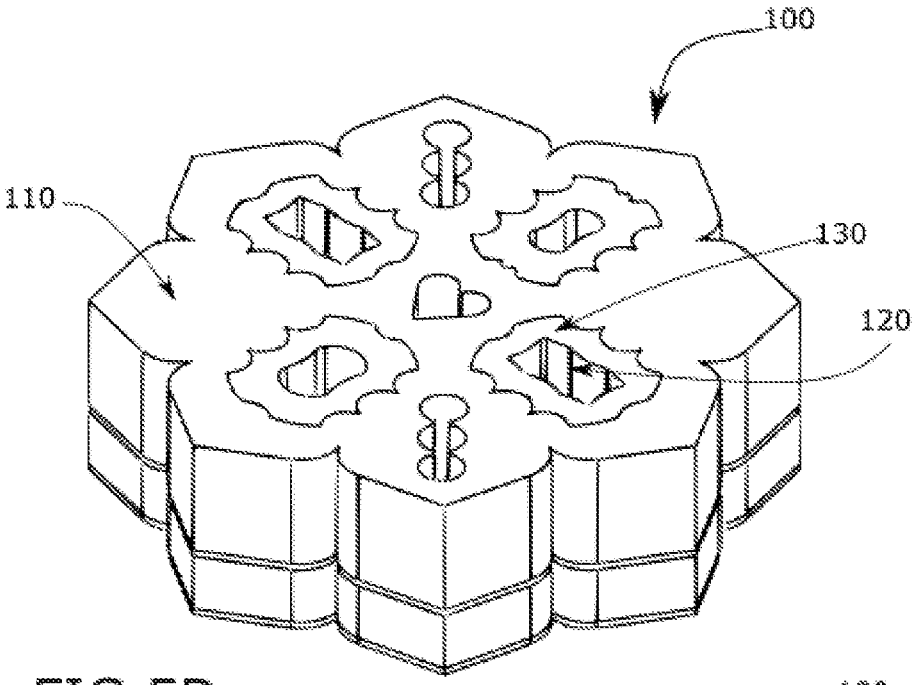
FIG. 5D is a side-top perspective view of the device of FIG. 1, according to an embodiment of the present disclosure.
Figure 5E:
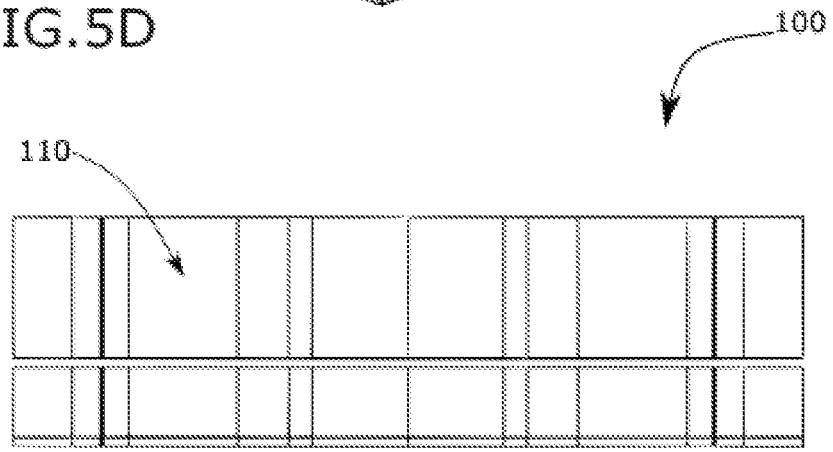
FIG. 5E is a side perspective view of the device of FIG. 1, according to an embodiment of the present disclosure.
Figure 5G:
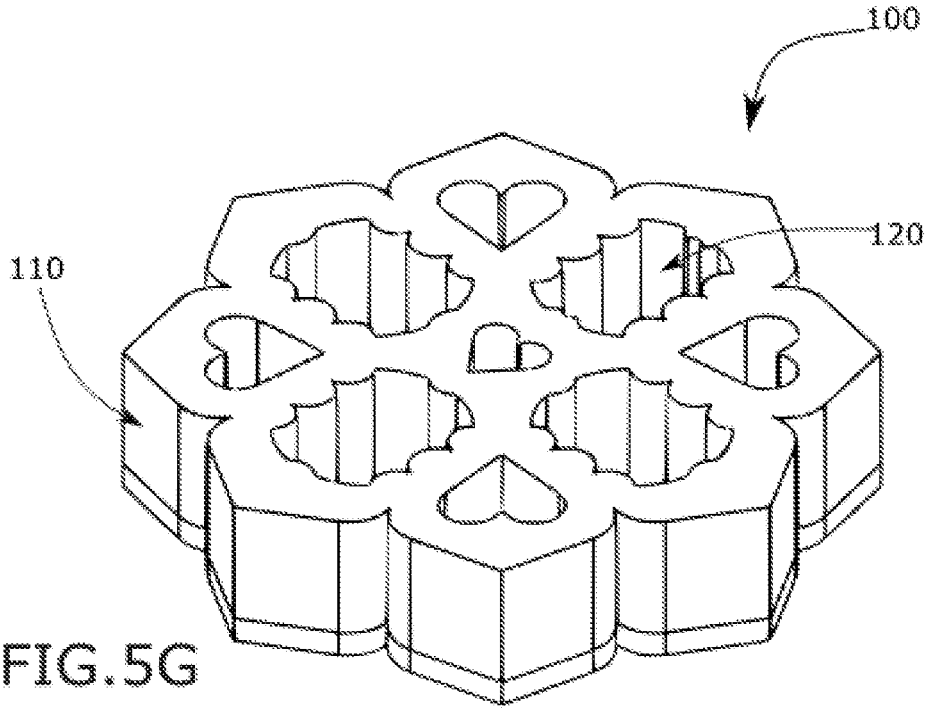
FIG. 5G is a side-top perspective view of the device of FIG. 1, according to an embodiment of the present disclosure.
Figure 5H:
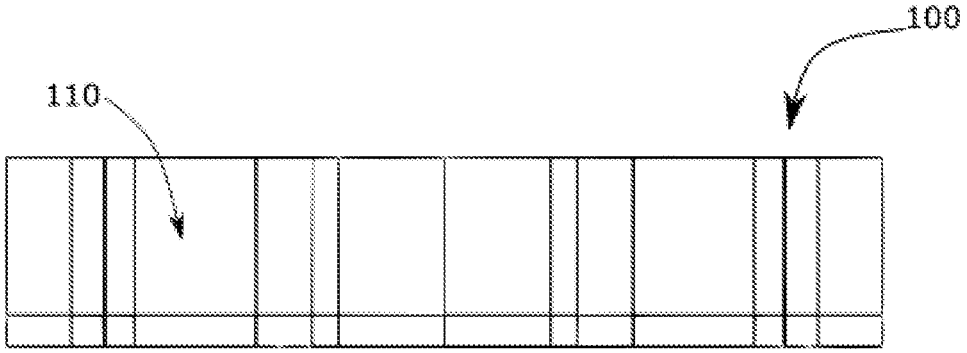
FIG. 5H is a side perspective view of the device of FIG. 1, according to an embodiment of the present disclosure.
Figure 5I:
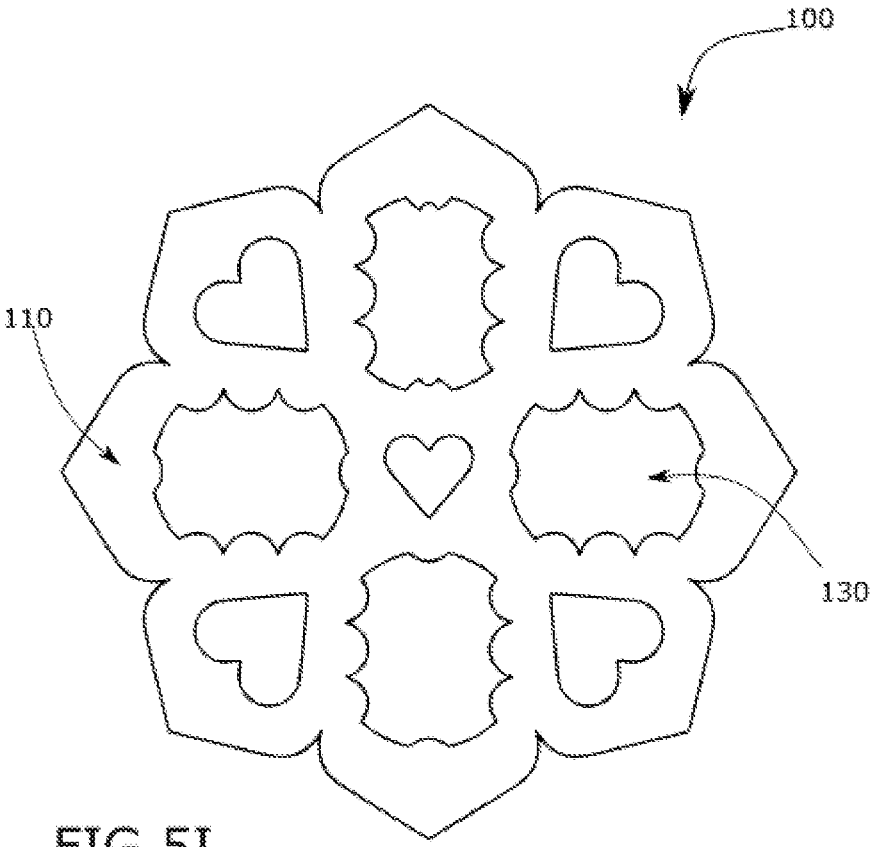
FIG. 5I is a top perspective view of the device of FIG. 1, according to an embodiment of the present disclosure.
Figure 5J:
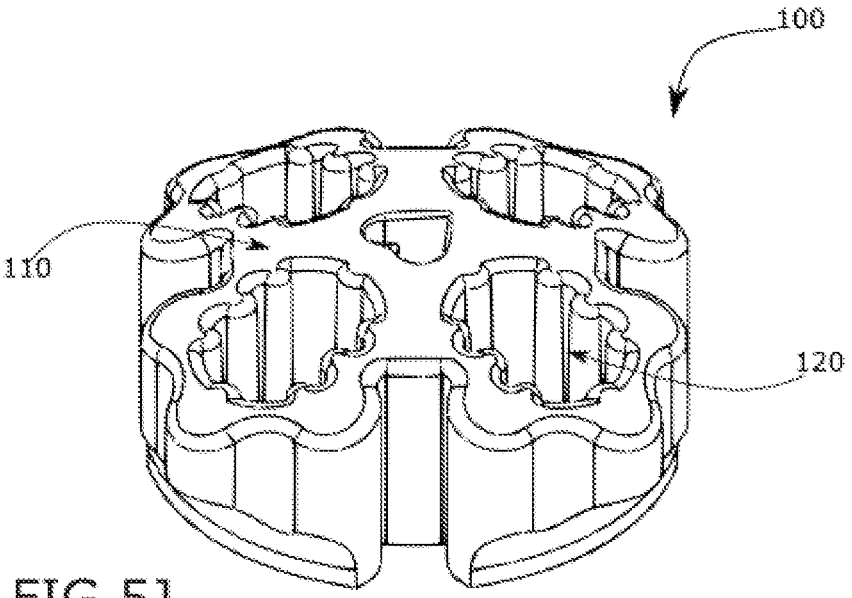
FIG. 5J is a side-top perspective view of the device of FIG. 1, according to an embodiment of the present disclosure.
Figure 5K:
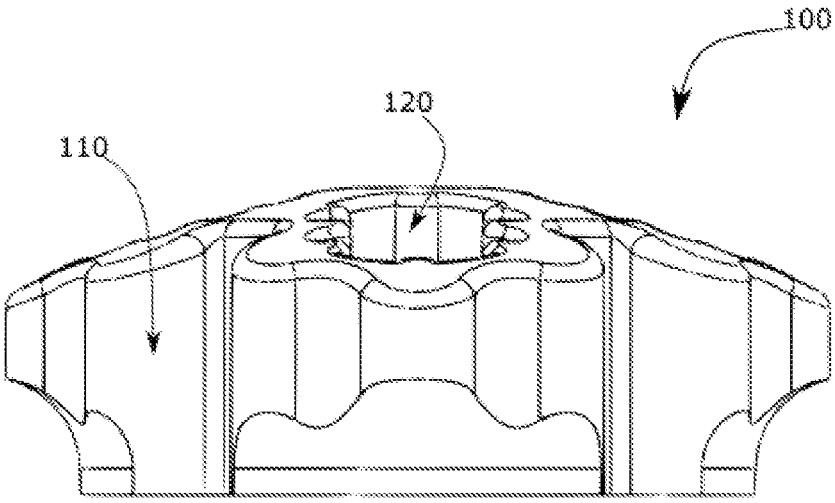
FIG. 5K is a side perspective view of the device of FIG. 1, according to an embodiment of the present disclosure.
Figure 5L:
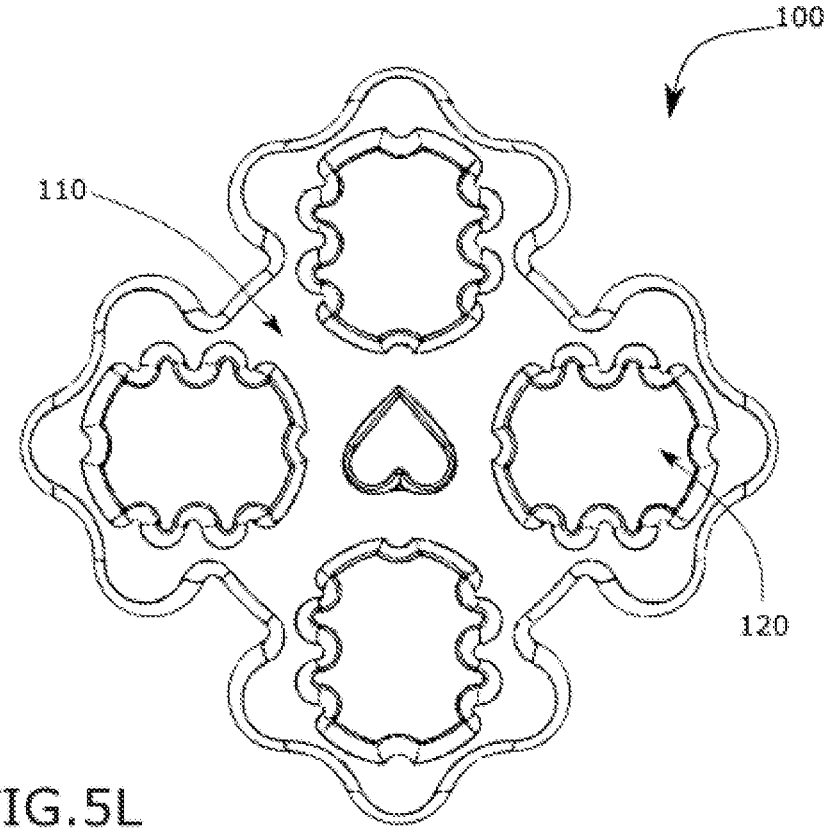
FIG. 5L is a top perspective view of the device of FIG. 1, according to an embodiment of the present disclosure.
Figure 5M:
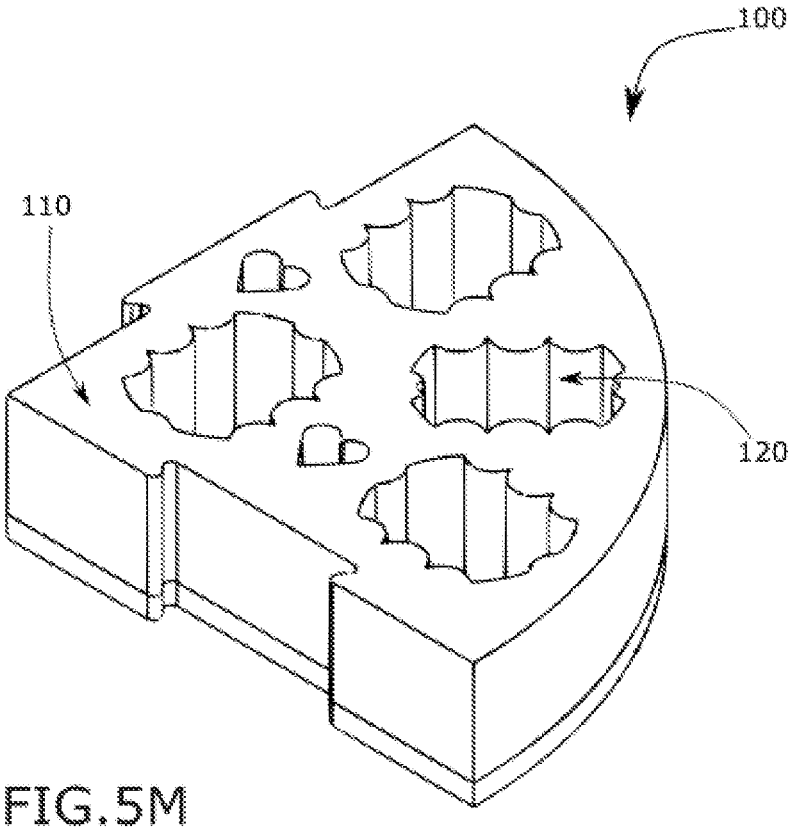
FIG. 5M is a side-top perspective view of the device of FIG. 1, according to an embodiment of the present disclosure.
Figure 5N:
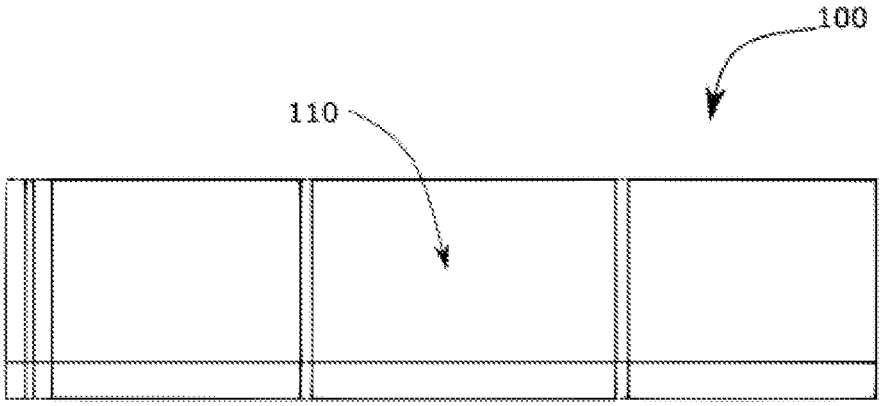
FIG. 5N is a side perspective view of the device of FIG. 1, according to an embodiment of the present disclosure.
Figure 5R:
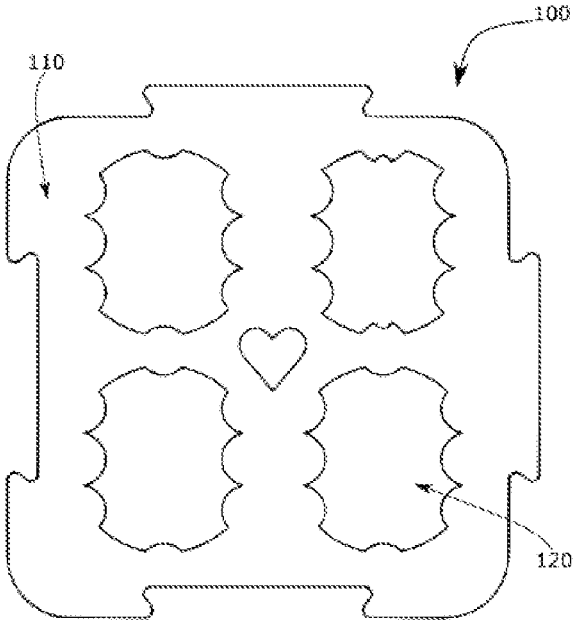
FIG. 5R is a top perspective view of the device of FIG. 1, according to an embodiment of the present disclosure.
Figure 5O:
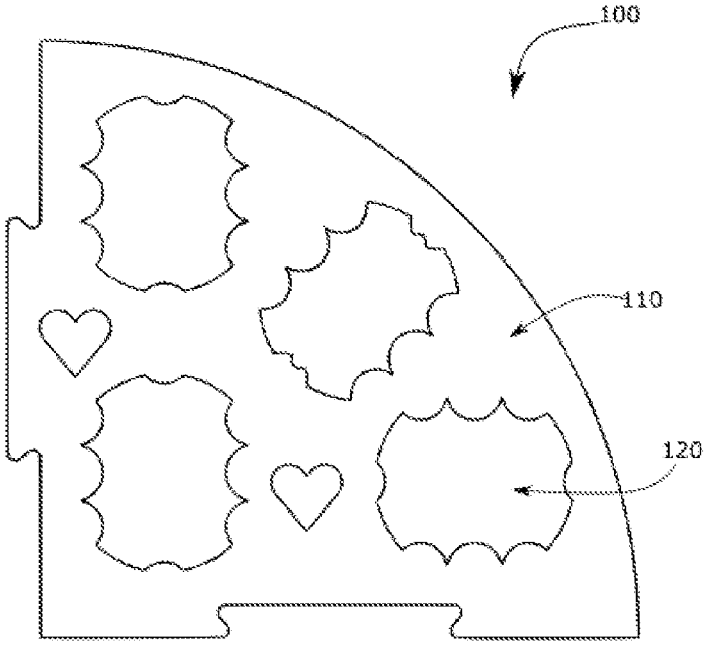
FIG. 5O is a top perspective view of the device of FIG. 1, according to an embodiment of the present disclosure.
Figure 5P:
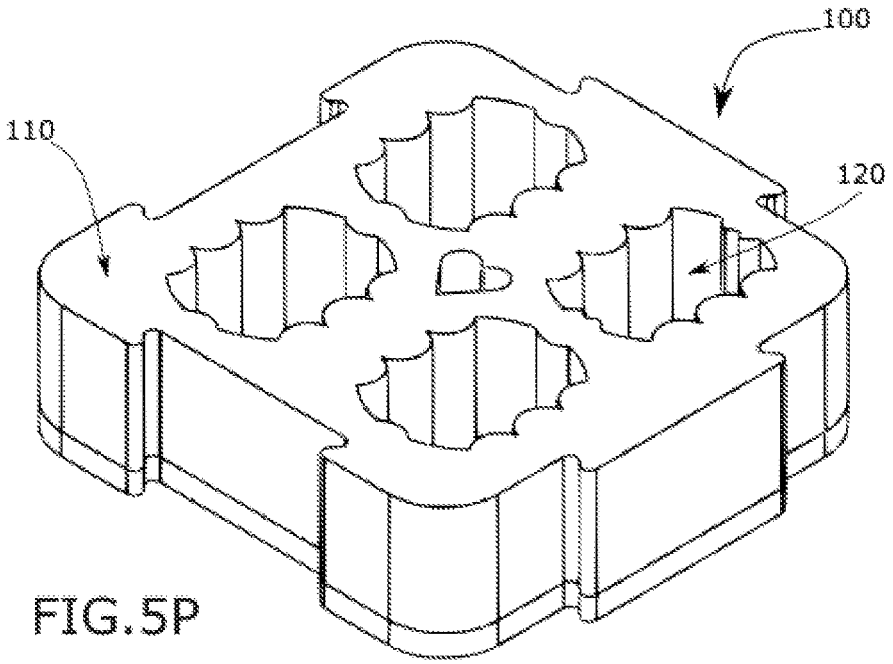
FIG. 5P is a side-top perspective view of the device of FIG. 1, according to an embodiment of the present disclosure.
Figure 5Q:
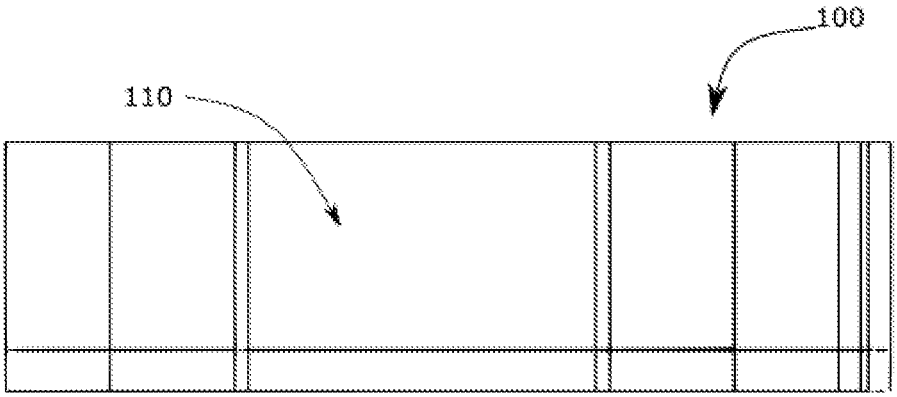
FIG. 5Q is a side perspective view of the device of FIG. 1, according to an embodiment of the present disclosure.
Figure 5S:
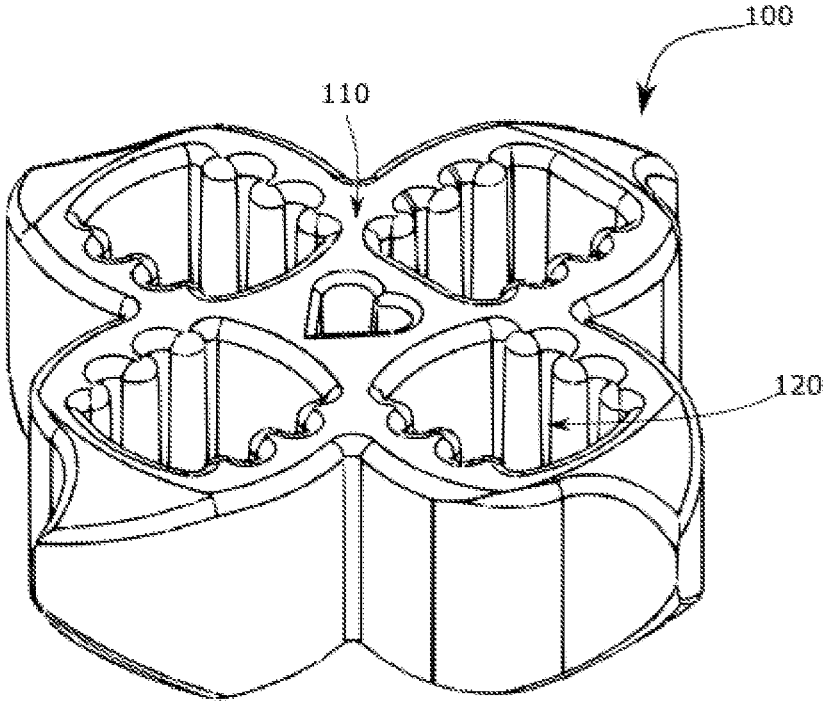
FIG. 5S is a side-top perspective view of the device of FIG. 1, according to an embodiment of the present disclosure.
Figure 5T:
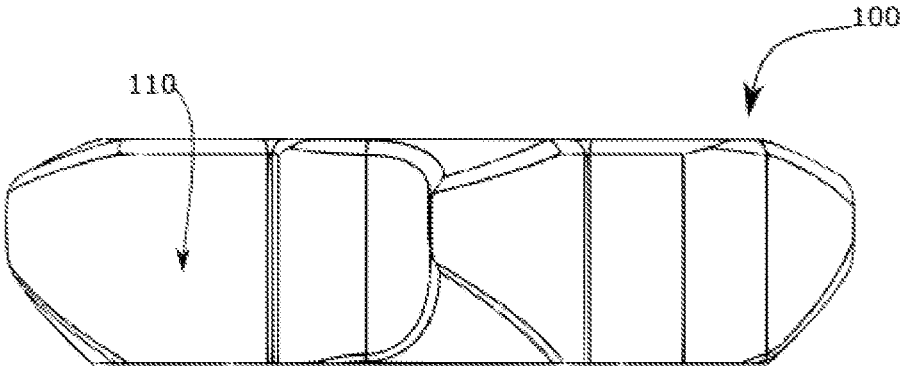
FIG. 5T is a side perspective view of the device of FIG. 1, according to an embodiment of the present disclosure.
Figure 6C:
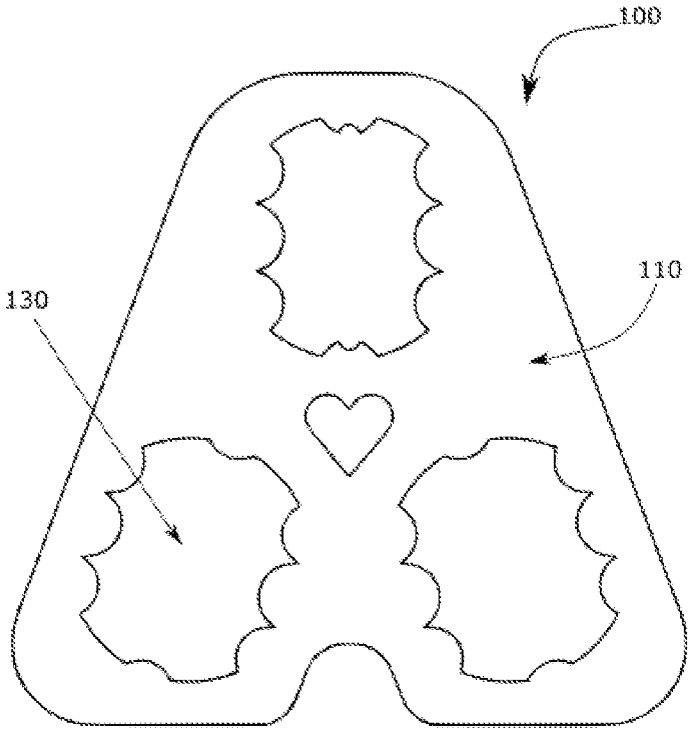
FIG. 6C is a top perspective view of the device of FIG. 1, according to an embodiment of the present disclosure.
Figure 5U:
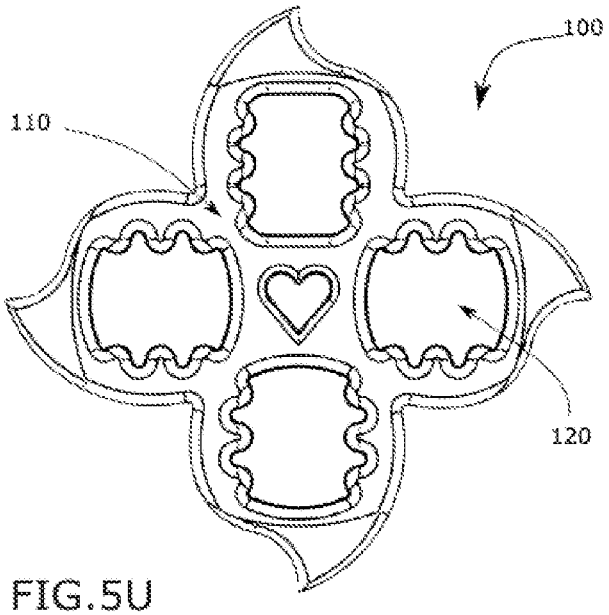
FIG. 5U is a top perspective view of the device of FIG. 1, according to an embodiment of the present disclosure.
Figure 6A:
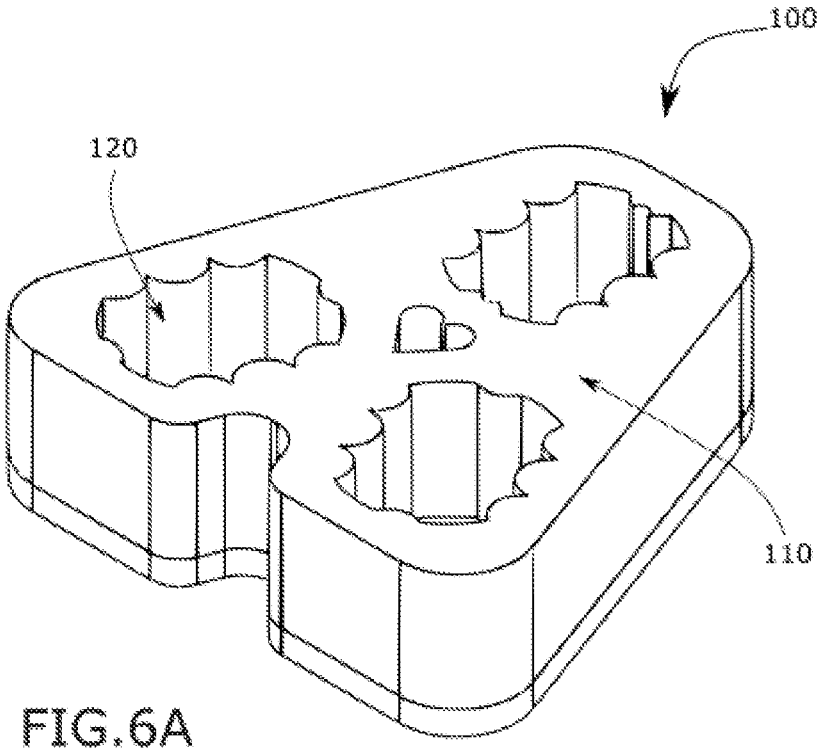
FIG. 6A is a side-top perspective view of the device of FIG. 1, according to an embodiment of the present disclosure.
Figure 6B:
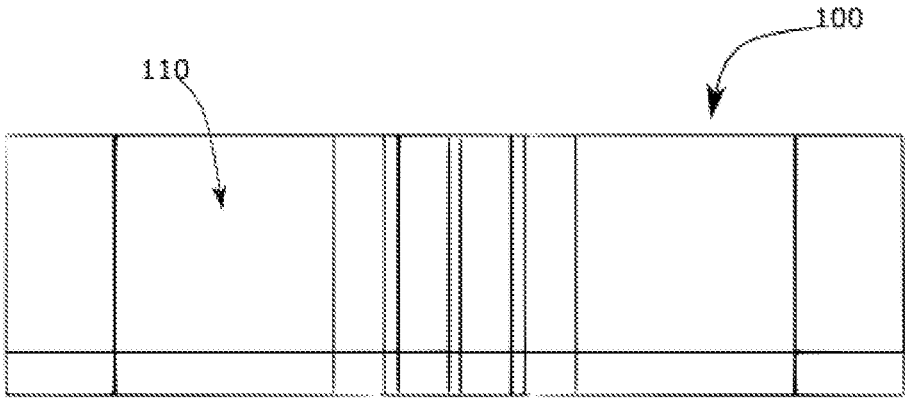
FIG. 6B is a side perspective view of the device of FIG. 1, according to an embodiment of the present disclosure.
Figure 6D:
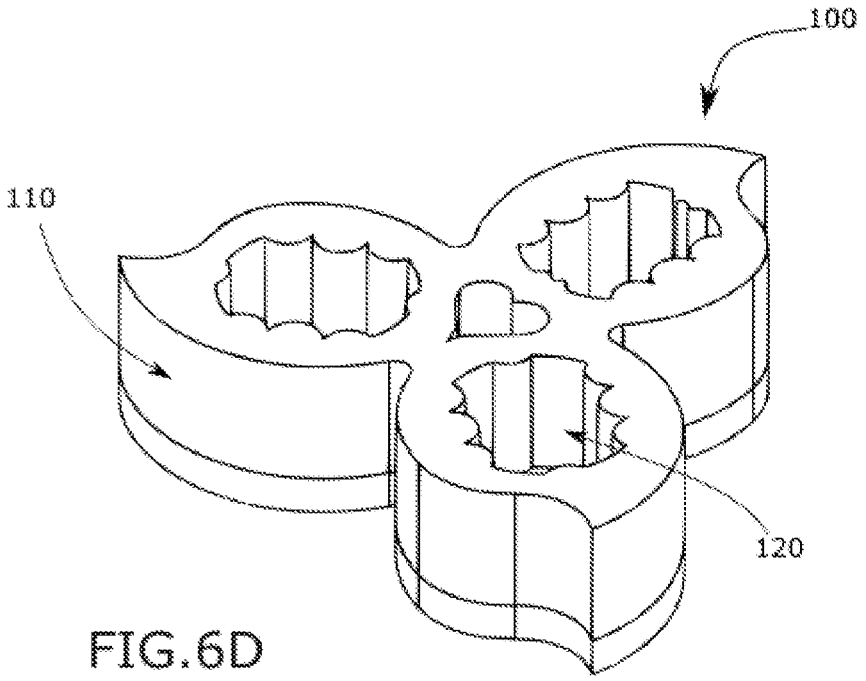
FIG. 6D is a side-top perspective view of the device of FIG. 1, according to an embodiment of the present disclosure.
Figure 6E:
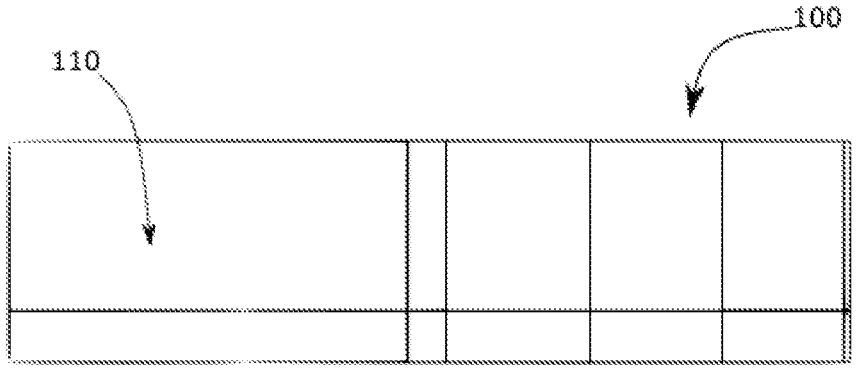
FIG. 6E is a side perspective view of the device of FIG. 1, according to an embodiment of the present disclosure.
Figure 6F:
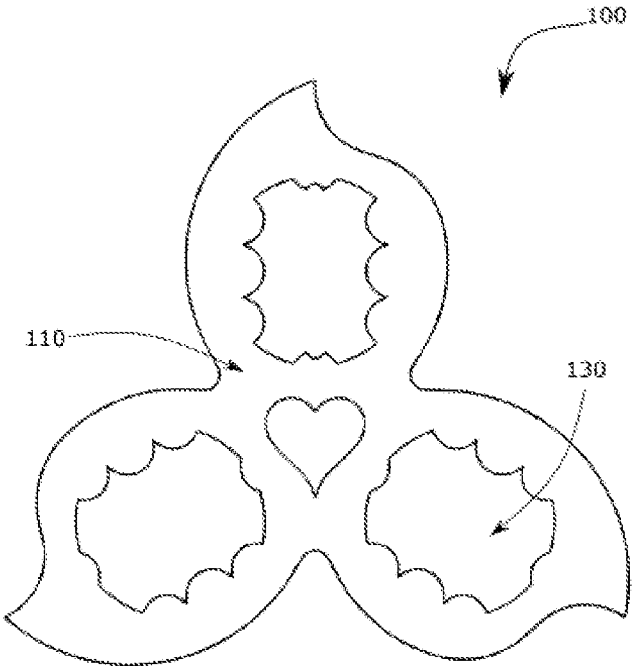
FIG. 6F is a top perspective view of the device of FIG. 1, according to an embodiment of the present disclosure.
Figure 7A:
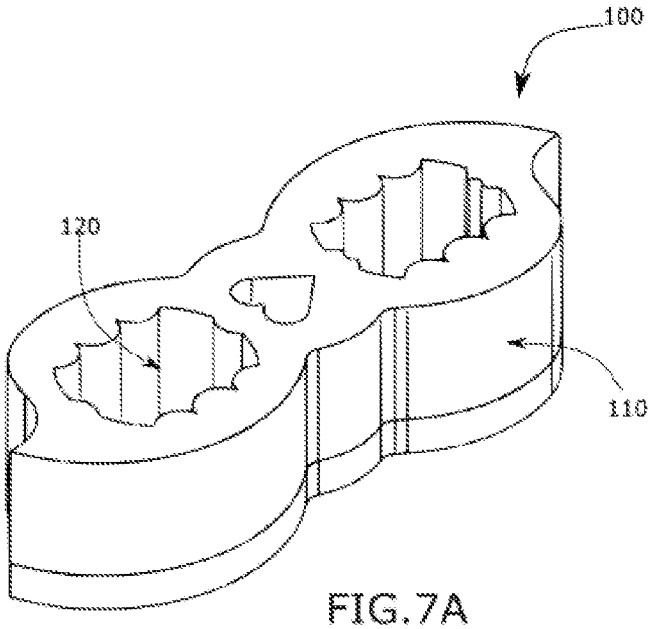
FIG. 7A is a side-top perspective view of the device of FIG. 1, according to an embodiment of the present disclosure.
Figure 7B:
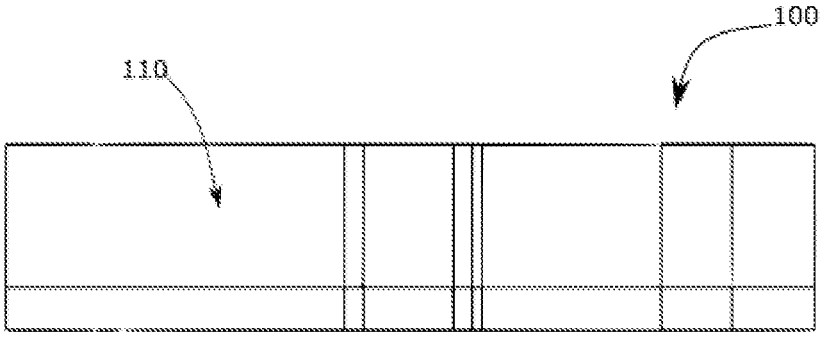
FIG. 7B is a side perspective view of the device of FIG. 1, according to an embodiment of the present disclosure.
Figure 7C:
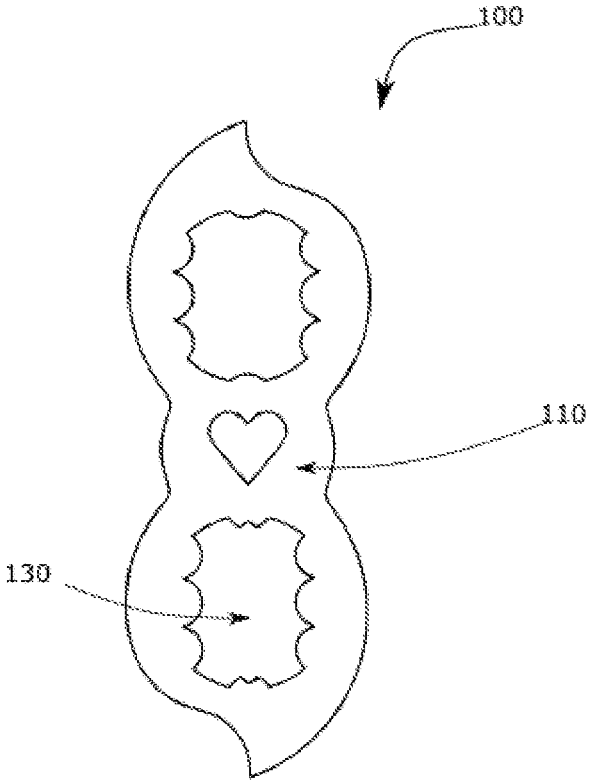
FIG. 7C is a top perspective view of the device of FIG. 1, according to an embodiment of the present disclosure.
Figure 8D:
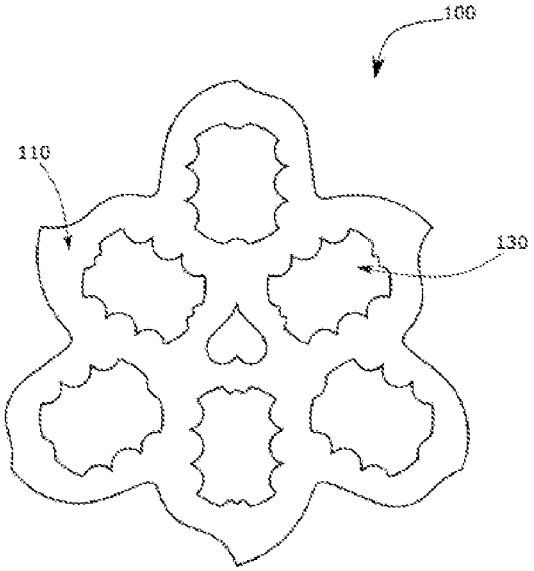
FIG. 8D is a top perspective view of the device of FIG. 1, according to an embodiment of the present disclosure.
Figure 8A:
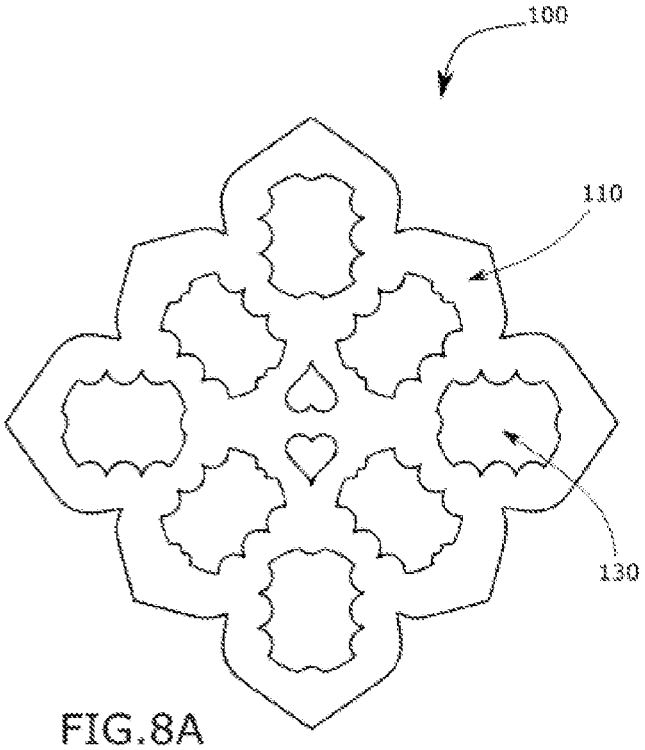
FIG. 8A is a top perspective view of the device of FIG. 1, according to an embodiment of the present disclosure.
Figure 8B:
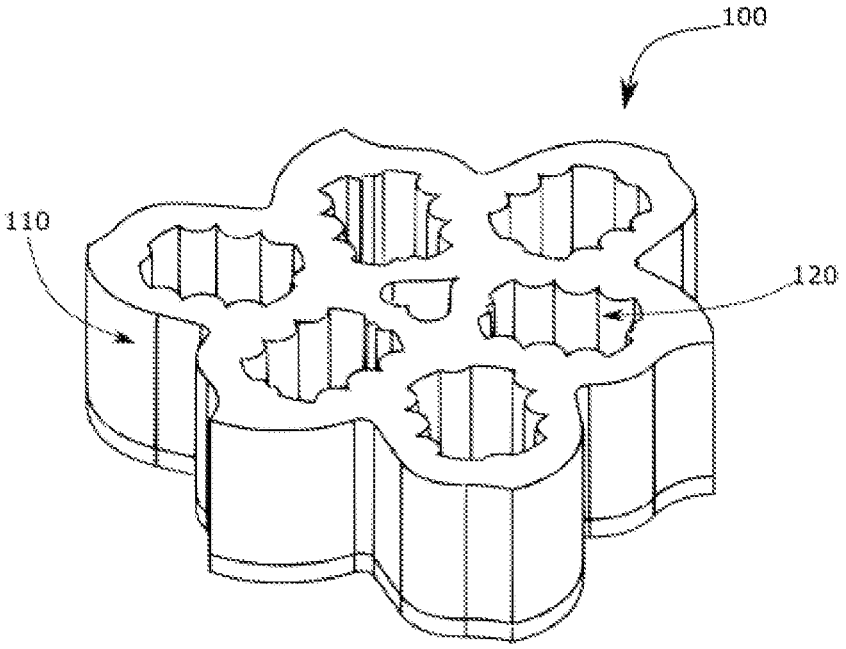
FIG. 8B is a side-top perspective view of the device of FIG. 1, according to an embodiment of the present disclosure.
Figure 8C:
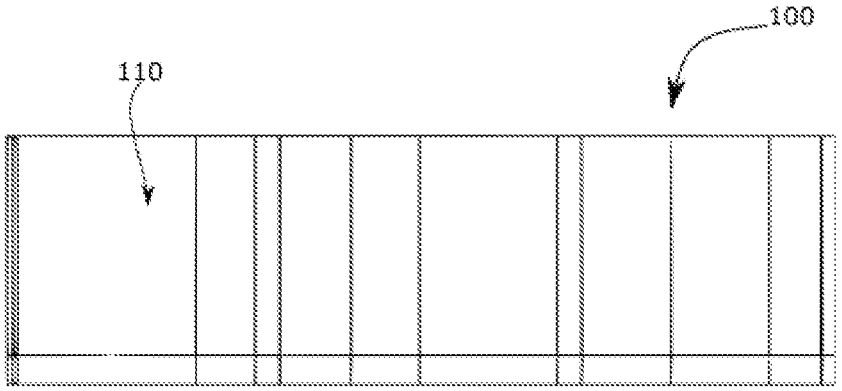
FIG. 8C is a side perspective view of the device of FIG. 1, according to an embodiment of the present disclosure.

Demonstrated in FIGS. 5A-5U is various perspective views of the device 100 in one embodiment having the base 110 including four cavities 120 and four inserts 130 therein. Demonstrated in FIGS. 6A-6F shows the device 100 including the base 110 having three cavities 120 and three inserts 130 therein. Demonstrated in FIGS. 7A-7 is the device 100 having the base 110 including two cavities 120 and two inserts 130 therein. Further, demonstrated in FIGS. 8A-8D is the device 100 having the base 110 including the base 110 having varying amounts of cavities 120 and inserts 130. It should be appreciated that the amount of cavities 120 may not always match the amount of inserts 130. For example, the device 110 may be provided with the base having four cavities 120 and three inserts 130. Each insert 130 may have eight indexing fingers 240. The eight indexing fingers 240 may be further characterized and subdivided into two pointed-fingers 242 which are disposed along a first-edge 252, two broad-tabs 244 which are disposed along a second-edge 254, two pointed-fingers 246 which are disposed along a third-edge 256, and two broad-tabs 248 which are disposed along a fourth-edge 258. First-edge 252 may be opposite the third-edge 256, and the second-edge 254 may be opposite the fourth-edge 258. Each of cavity 236 (FIG. 2) may be shaped and dimensioned to conform to, accept, and index with the eight indexing fingers 240. Each of cavity 236 (FIG. 2) and the aperture may be bored perpendicularly to each of the flat bottom 210 (FIG. 2) and the flat top 200 (FIG. 2).

Figure 9:
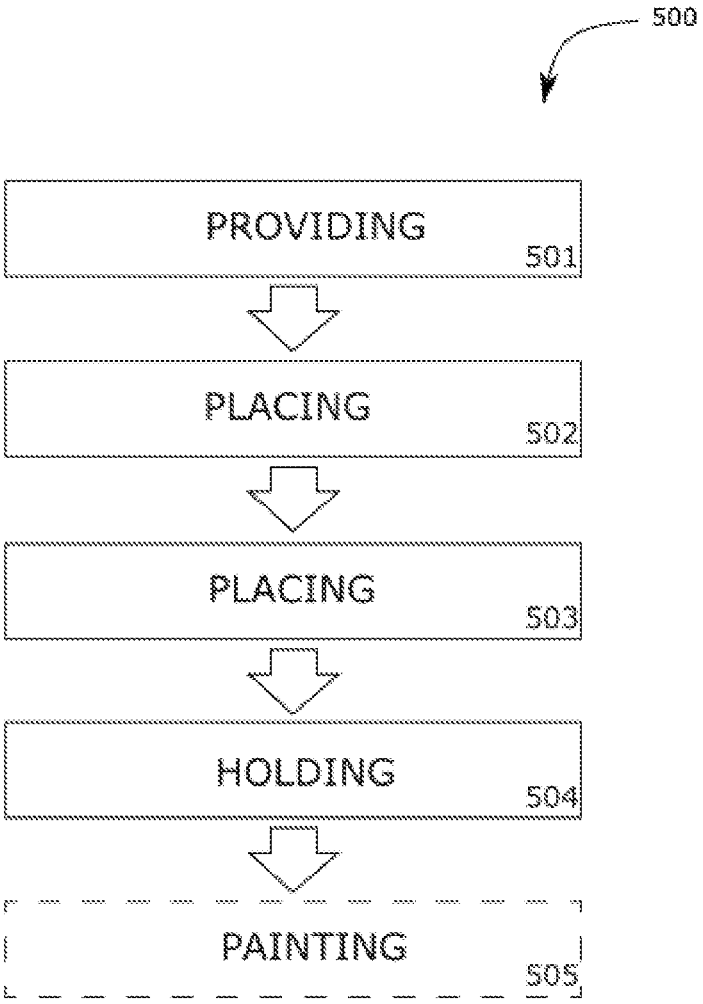
FIG. 9 is a flow diagram illustrating a method of use for the device, according to an embodiment of the present disclosure.

FIG. 9 is a flow diagram illustrating a method of using a device for holding at least one nail polish bottle 500, according to an embodiment of the present disclosure. As illustrated, the method of using a device for holding at least one nail polish bottle 500 may include the steps of: providing 501 the device as above; removing the at least one insert from the at least one cavity; placing 502 the bottle end of the nail polish bottle into the at least one cavity; and placing 503 the cap end of the nail polish bottle into the hollow. Further steps may include holding 504 the at least one insert, the cap end 10 of the nail polish being gripped in the hollow of the at least one insert; and painting 505 nails of a user with a brush on the cap end of the nail polish.

It should be noted that steps 504 and 505 are optional steps and may not be implemented in all cases. Optional steps of method of use 500 are illustrated using dotted lines in FIG. 9 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for device 100 (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A device for holding at least one nail polish bottle, the at least one nail polish bottle including a cap end and a bottle end, the device comprising:
- a base having
  - a top surface, a bottom surface, and a thickness therebetween, the top surface and bottom surface each being flat and parallel to each other,
  - four lobes arrayed radially about a center of the base, each lobe having a pointed terminating edge distal to the center of the base;
  - one cavity in each lobe, and
  - an aperture central to the base;
  - four inserts configured for removable placement within each cavity, each of the four inserts including a hollow having a hollow-capacity sized to selectively grip and hold at least the cap end of the nail polish bottle, each of the four inserts having eight indexing fingers, the eight indexing fingers comprising
    - two pointed-fingers disposed along a first-edge,
    - two broad-tabs disposed along a second-edge,
    - two pointed-fingers disposed along a third-edge,
    - two broad-tabs disposed along a fourth-edge,
    - whereby the first-edge is opposite the third-edge, and the second-edge is opposite the fourth-edge;
  - wherein each cavity is shaped to conform to and index with the eight indexing fingers;
  - wherein that each cavity and the aperture are each bored perpendicularly to the flat bottom and the flat top.

2. The device of claim 1, wherein the bottom surface of the base includes a non-slip material.

3. The device of claim 1, wherein the base is constructed from a foam material.

4. The device of claim 3, wherein the foam material is Cross Linked Polyethylene Foam.

5. A device for holding at least one nail polish bottle, the at least one nail polish bottle including a cap end and a bottle end, the device comprising:
- a base having a top surface, a bottom surface, and a thickness therebetween, the top surface and bottom surface each being flat and parallel to each other, four lobes arrayed radially about a center of the base, each lobe having a pointed terminating edge distal to the center of the base, one cavity in each lobe, and an aperture central to the base, four inserts configured for removable placement within each cavity, each of the four inserts including a hollow having a hollow-capacity sized to selectively grip and hold at least the cap end of the nail polish bottle, each of the four inserts having eight indexing fingers, the eight indexing fingers;
- a nail tool pocket having a pocket capacity configured to selectively hold at least one nail tool and in communication with the aperture of the base; and
- wherein the bottom surface of the base includes a non-slip material; and
- wherein the base is constructed from a foam material.

6. A method of using a device for holding at least one nail polish bottle, the at least one nail polish bottle including a cap end and a bottle end, the method comprising the steps of:
- providing the device for holding at least one nail polish bottle, the device including:
  - a base having a top surface, a bottom surface, and a thickness therebetween, the top surface and bottom surface each being flat and parallel to each other, four lobes arrayed radially about a center of the base, each lobe having a pointed terminating edge distal to the center of the base, one cavity in each lobe, and an aperture central to the base, four inserts configured for removable placement within each cavity, each of the four inserts including a hollow having a hollow-capacity sized to selectively grip and hold at least the cap end of the nail polish bottle, each of the four inserts having eight indexing fingers, the eight indexing fingers;
- removing at least one of the four inserts from the one cavity;
- placing the bottle end of the nail polish bottle into the one cavity; and
- placing the cap end of the nail polish bottle into the hollow.

7. The method of claim 6, further comprising the steps of:

holding the one insert, the cap end of the nail polish being gripped in the hollow of the at least one insert; and painting nails of a user with a brush on the cap end of the nail polish.

8. The device of claim 1, wherein each cavity is chamfered to expedite insertion of each insert into a corresponding cavity.

* * * * *